US010239108B2

(12) United States Patent
Bonnen et al.

(10) Patent No.: US 10,239,108 B2
(45) Date of Patent: Mar. 26, 2019

(54) METHOD FOR ELECTRO-HYDRAULIC FORMING

(71) Applicant: Ford Global Technologies, LLC, Dearborn, MI (US)

(72) Inventors: John Joseph Francis Bonnen, Milford, MI (US); Sergey Fedorovich Golovashchenko, Beverly Hills, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 708 days.

(21) Appl. No.: 14/859,955

(22) Filed: Sep. 21, 2015

(65) Prior Publication Data

US 2016/0008865 A1 Jan. 14, 2016

Related U.S. Application Data

(62) Division of application No. 13/590,506, filed on Aug. 21, 2012, now abandoned.

(51) Int. Cl.
*B21D 26/12* (2006.01)

(52) U.S. Cl.
CPC ..... *B21D 26/12* (2013.01)

(58) Field of Classification Search
CPC ..... B26D 26/12
See application file for complete search history.

(56) References Cited

U.S. PATENT DOCUMENTS

| | | | | |
|---|---|---|---|---|
| 3,232,086 | A | 2/1966 | Inoue | |
| 3,491,564 | A * | 1/1970 | Russell | B21D 26/12 72/56 |
| 4,372,910 | A * | 2/1983 | Stroup | B29C 45/125 264/328.8 |
| 6,591,649 | B1 * | 7/2003 | Gafri | B21D 26/12 29/421.1 |
| 7,197,970 | B2 | 4/2007 | Golovashchenko et al. | |
| 7,493,787 | B2 | 2/2009 | Golovashchenko et al. | |
| 7,540,180 | B2 | 6/2009 | Golovashchenko et al. | |
| 7,802,457 | B2 * | 9/2010 | Golovashchenko | B21D 26/00 29/419.2 |

(Continued)

OTHER PUBLICATIONS

Harris, Robert & Ioannou, Photios "Repetitive Scheduling Method," Nov. 1998, Universityof Michigan UMCEE Report No. 98-25, 56 Pages.*

(Continued)

*Primary Examiner* — Edward T Tolan
*Assistant Examiner* — Gregory D Swiatocha
(74) *Attorney, Agent, or Firm* — Ray Coppiellie; Brooks Kushman P.C.

(57) ABSTRACT

One or more electro-hydraulic forming tools are operated by a press and provide formed parts to a trimming operation. A locking mechanism holds the die against the chamber during the electro-hydraulic forming (EHF) discharge. The lock may be a pin or clamp. One method of manufacturing an article includes providing three EHF tools that feed a single trimming press on a line. An alternative embodiment discloses a single EHF tool that supplies parts on a production line to an electro-hydraulic (EH) trimming tool. An electro-hydraulic pulse generator may be used to provide a stored charge to the EHF tool and the EH trimming tool.

7 Claims, 4 Drawing Sheets

(56) References Cited

U.S. PATENT DOCUMENTS

| | | | | |
|---|---|---|---|---|
| 7,810,366 | B2 | 10/2010 | Golovashchenko | |
| 8,534,106 | B2 | 9/2013 | Golovashchenko | |
| 2005/0022640 | A1 | 2/2005 | Golovashchenko et al. | |
| 2010/0175447 | A1* | 7/2010 | Golovashchenko ... | B21D 24/16 72/55 |
| 2012/0160004 | A1 | 6/2012 | Golovashchenko | |
| 2012/0180542 | A1 | 7/2012 | Golovashchenko | |

OTHER PUBLICATIONS

Luo et al., Two-stage hybrid batching flowshop scheduling with blocking and machine availability constraints using genetic algorithm, Robotics and Computer-Integrated Manufacturing, 2009, 10 Pages.*

* cited by examiner

82

| | One Complete Cycle Through All EHF Presses | | |
|---|---|---|---|
| EHF Pulse Generator | | | |
| Cycle Phase | Phase 1 | Phase 2 | Phase 3 |
| EHF Press 1 | Load Blank 1, Clamp Tool, and Fill Chamber | Form Part 1 5 EHF Pulses | Drain Chamber, Unclamp Tool, Unload Part 1 |
| EHF Press 2 | Drain Chamber, Unclamp Tool, Unload Part 2 | Load Blank 2, Clamp Tool, and Fill Chamber | Form Part 2 5 EHF Pulses |
| EHF Press 3 | Form Part 3 5 EHF Pulses | Drain Chamber, Unclamp Tool, Unload Part 3 | Load Blank 3, Clamp Tool, and Fill Chamber |
| Trimming Press | Trim Part 1 Previous Cycle | Trim Part 2 Previous Phase | Trim Part 3 Previous Phase |
| Timing | 12 seconds | 12 seconds | 12 seconds |
| Elapsed Cycle Time | 12 seconds | 24 seconds | 36 seconds |

Fig-5

METHOD FOR ELECTRO-HYDRAULIC FORMING

CROSS-REFERENCE TO RELATED APPLICATIONS

This application is a division of U.S. application Ser. No. 13/590,506 filed Aug. 21, 2012, the disclosure of which is hereby incorporated in its entirety by reference herein.

STATEMENT REGARDING FEDERALLY SPONSORED RESEARCH OR DEVELOPMENT

The invention was made with Government support under Contract No. DE-FG36-08GO1828. The Government has certain rights to the invention.

TECHNICAL FIELD

This disclosure relates to electro-hydraulic manufacturing operations including electro-hydraulic forming operations and a trimming operation.

BACKGROUND

Electro-hydraulic Forming (EHF) is a process in which capacitors provide a high-voltage discharge across two electrodes positioned in a fluid-filled chamber. Electrical energy (typically between 5 and 50 kJ) is stored in a bank of capacitors that are discharged across a gap between two electrodes that are immersed in water (or other conductive and relatively incompressible liquid medium) over a very short period of time (usually less than 1 millisecond).

A typical EHF system consists of electrically isolated electrodes that are inserted through a thick-walled hollow cavity that is filled with water. A sheet metal blank is placed on top of the cavity. A one-sided female die is placed facing downwardly above the blank. Air is evacuated from both sides of the blank. A capacitor bank is charged and is then discharged through the electrodes. About a millisecond after the voltage is applied to the electrodes, a high temperature plasma channel forms, and current from the capacitors drives and expands the plasma channel. The region surrounding the plasma channel is filled with gas in the form of superheated steam which transitions to a steam/water interface. The chamber is filled with relatively incompressible fluid, such as water, and all air is evacuated. A high intensity, high velocity shock wave forms in the liquid causing immense pressure to rapidly build up and the sheet metal blank is explosively driven into the die. Since the liquid transmits the force, only the female die is required.

EHF has several benefits over conventional stamping and other lower strain rate sheet metal manufacturing processes. Due to the single-sided tooling, EHF has a lower capital cost than conventional stamping. EHF also provides significantly increased formability in many sheet metal materials due to the elevated strain rates that result from the discharge. It requires only a single die—potentially, the multiple die sets that are used to form complex parts can be reduced down to a single die (this reduction is achieved by using multiple pulses in specific energy increments to form the blank). Significant residual stress reductions can be achieved by delivering a post forming pulse to the blank to greatly reduce blank distortion caused by stored elastic energy (springback). This process can significantly reduce the die development costs (easily the single greatest production cost, often in the neighborhood of a million dollars for a single large part), because the die can be cut to the part's final geometry rather than requiring additional forming processes to compensate for springback.

The EHF process offers potential advantages as a method of manufacturing automotive and truck components from high-strength steel, stainless steel, and aluminum alloys, but the time required to fill the chamber with water, evacuate the air from the chamber and then drain the chamber results in low production rates. The combination of air/water management cycling times and the maximum rate at which the EHF electrical pulse generator operates means that an entire EHF cycle may take, for example, approximately 36 seconds. Approximately 70% of this time is dedicated to water and air management, and opening and closing of the press. The EHF pulse generator itself is capable of producing a discharge every two seconds at full speed. Trimming presses are capable of trimming a part, for example, every 10-12 seconds, or less. A single EHF forming press associated with a single trimming press may result in the trimming die being idle for two thirds of the time.

Smaller capacity presses may be used for EHF tools because the reciprocating movement of the press is not used to form the part. Instead the press is opened and closed by a hydraulic actuator and the part is formed by the short duration pulse or pulses. The press must have sufficient capacity to resist the force of the intense discharge.

This disclosure is directed to solving the above problems and other problems as summarized below.

SUMMARY

According to one aspect of this disclosure, a press is provided for forming a blank in an electro-hydraulic forming (EHF) tool defining a chamber that is filled with a liquid. An electrode is disposed within the chamber that provides a plasma arc in the liquid when connected to a source of stored charge that results in an EHF discharge. A one-sided die is reciprocated by the press relative to the chamber while the blank is disposed on the die. A lock is connected to and operated by the press that holds the die against the chamber during the EHF discharge.

According to other aspects of the disclosure as it relates to the press, the lock may further comprise a mechanical restraining device that selectively connects a movable platen of the EHF machine supporting the die to a portion of frame of the press. The mechanical restraining device may be a pin carried by the frame of the press that is shifted into engagement with the movable plate.

According to further aspects of the disclosure, an alternative press wherein the lock may comprise a clamp that selectively clamps the die against the EHF tool, wherein a hydraulic ram moves the clamp relative to the EHF tool in a direction transverse to the direction that the die is reciprocated. The clamp may include a first stop that engages the die and a second stop that engages the EHF tool.

According to another aspect of the disclosure, a method is disclosed for manufacturing an article on a production line that includes a plurality of electro-hydraulic forming (EHF) tools and a plurality of one-sided dies that are each operated by a press. The production line also includes a trim press. The method comprises clamping a blank onto each of the plurality of the EHF tools and the one-sided dies in a progressive sequence. Discharging each of the EHF tools in the progressive sequence to form a part shape in the blank and trimming the blanks that are formed to include the part shape in the trim press.

According to other aspects of the method, the plurality of EHF tools and one-sided dies may include three EHF tools and three one-sided dies that are operated by three presses and wherein the progressive sequence further comprises operating the presses in a repeating order. The cycle time for the trim press may be about one-third of the cycle time for each press. Alternatively, the cycle time for the trim press may be about equal to the reciprocal of the number of the plurality of presses.

According to other aspects of the method, the method may further comprise filling a chamber defined by the EHF tool with water. Evacuating air from the EHF tool prior to the discharging step and draining the water from the EHF tool. The time required for the clamping step, the filling step, the evacuating step, the discharging step and the draining step is a multiple of the time required for trimming the blanks formed to include the part shape in the trim press. The multiple corresponds to the number of EHF tools. The discharging step may further comprise multiple discharges of the EHF tool to complete forming the part shape.

According to another aspect of the disclosure, an alternative method of manufacturing an article on a production line is disclosed that includes an electro-hydraulic forming (EHF) tool and a one-sided die that are operated by a press. The production line also includes an EHF trim press. The alternative method may comprise clamping a blank onto the EHF tool and the one-sided die. Discharging the EHF tool to form a part shape in the blank. The blank with the part shape may be trimmed in an electro-hydraulic (EH) trim press.

According to other aspects of the alternative method, the method may further comprise filling a chamber defined by the EHF tool with water. Evacuating air from the EHF tool prior to the discharging step and draining the water from the EHF tool.

These and other aspects of the disclosure will be described with reference to the attached drawings in the following detailed description of the illustrated embodiments.

BRIEF DESCRIPTION OF THE DRAWINGS

FIG. 5 is a forming operation and a trimming operation diagram illustrating an example of a press line operation sequence that may be accomplished in accordance with the process flowchart of FIG. 4.

DETAILED DESCRIPTION

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

Figure 1:
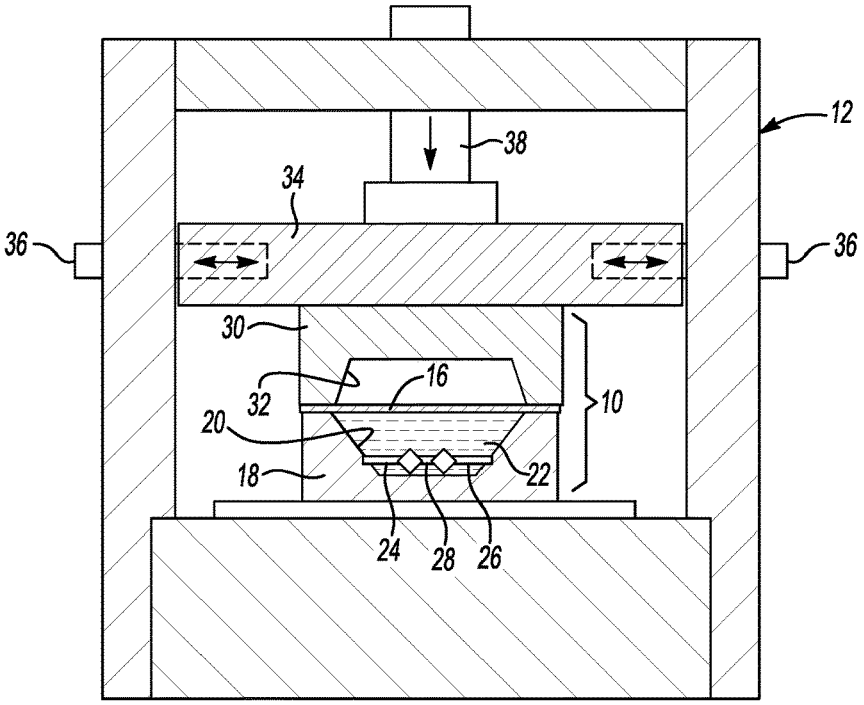
FIG. 1 is a diagrammatic cross-section view of an electro-hydraulic forming tool in a press.

Referring to FIG. 1, an electro-hydraulic forming (EHF) tool 10 is shown disposed in a press 12 that is preferably a hydraulic press. A blank 16 is shown in the EHF tool 10. The blank 16 is disposed on top of an EHF vessel 18 that defines a chamber 20. A conductive liquid 22, such as water, is contained within the chamber 20. A first electrode 24 and a second electrode 26 are received in the EHF vessel 18 with the first and second electrodes 24 and 26 defining a discharge gap 28 within the chamber 20.

A one-sided die 30 defines a die cavity 32. The blank 16 is formed into the die cavity 32 during the EHF forming process. The press 12 includes a movable platen 34. The one-sided die 30 is secured to the movable platen 34 that moves the one-sided die 30 into and out of engagement with the EHF vessel 18. A pair of locking pins 36, or wedges, are provided to lock the movable platen 34 to the press 12. A hydraulic ram 38 is provided to move the movable platen 34 in a reciprocating manner relative to the EHF vessel 18. The locking pins 36 lock the one-sided die 30 to the press 12 when the ram 38 has moved the movable platen 34 carrying the one-sided die 30 into position to clamp the blank 16 to the EHF vessel 18. The locking pins 36 hold the one-sided die 30 against the EHF vessel 18 during the EHF pulses.

Figure 2:
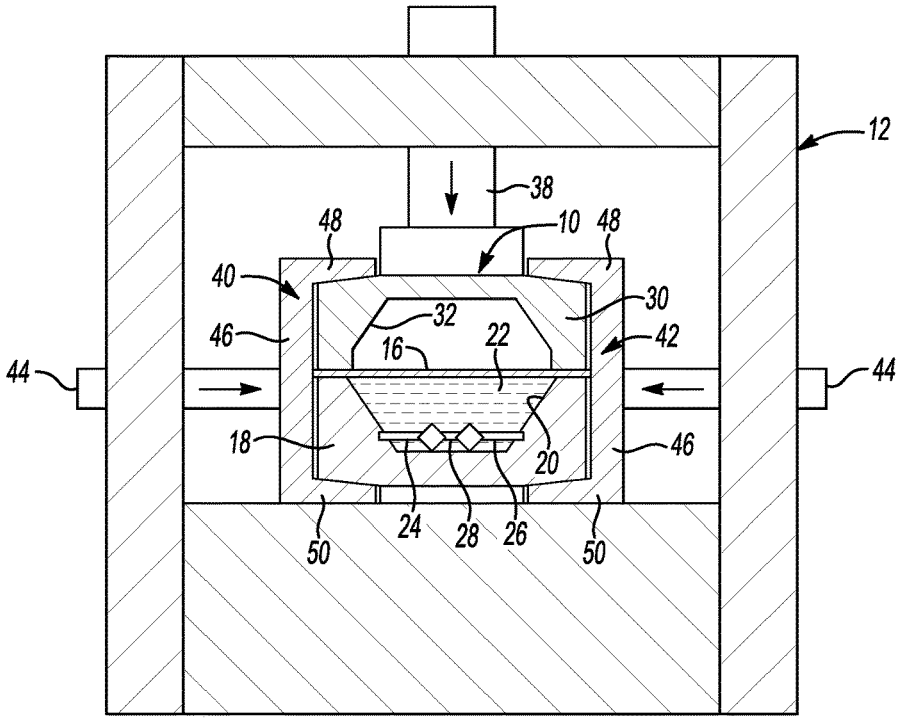
FIG. 2 is a diagrammatic cross-section view of an alternative embodiment of an electro-hydraulic forming tool in a press.

Referring to FIG. 2, an alternative embodiment of an EHF tool 10 in a press 12 is illustrated. For brevity, components that are similar to the embodiment of FIG. 1 are referred to by the same reference numerals in FIG. 2. The EHF tool 10 is shown disposed within a press 12. A blank 16 is placed on an EHF vessel 18 over a chamber 20 that contains a liquid 22. A first electrode 24 and a second electrode 26 are inserted into the chamber 20 and define a discharge gap 28. A one-sided die 30 defines a die cavity into which the blank 16 is formed by the EHF tool.

With continued reference to FIG. 2, a first clamp 40 and a second clamp 42 are moved into engagement with the EHF tool 10 and one-sided die 30 on opposite sides of the press 12. A hydraulic ram 44 links the first and second clamps 40 and 42 to the press 12. Each of the clamps 40 and 42 include a sidewall 46 that is shown connected to the hydraulic ram 44. An upper stop 48 engages the one-sided die 30 and a lower stop 50 engages the EHF vessel 18. The upper stop 48 and lower stop 50 are provided on the upper side of the sidewall 46 and the lower side of the sidewall 46. The upper stop 48 and lower stop 50 hold the one-sided die 30 against the EHF vessel 18 during one or more EHF pulses.

Figure 3:
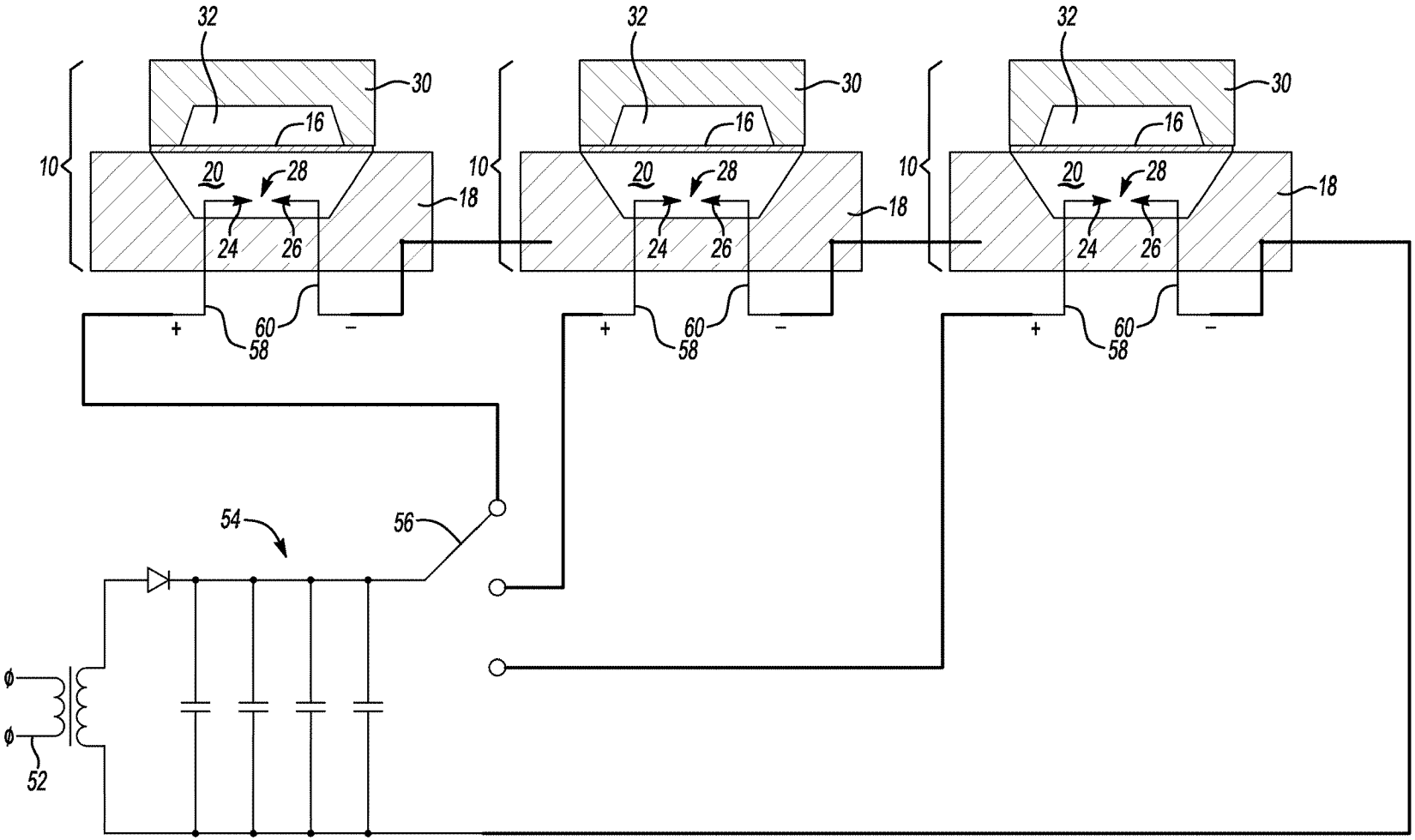
FIG. 3 is a diagrammatic electrical schematic showing three electro-hydraulic forming tools that are selectively connectable to a bank of capacitors.

Referring to FIG. 3, an electrical diagram is provided for actuating three EHF forming tools 10 in sequence. A power source 52 provides power to charge a bank of capacitors 54. The bank of capacitors 54 may also be referred to as a stored charge device or a pulse generator for the EHF tools 10. A switch 56 is shown connecting the bank of capacitors 54 to the left-most EHF tool 10 in FIG. 3. The switch 56 may selectively connect the bank of capacitors 54 to each one of the three EHF tools 10. The switch 56 is part of the controller (not shown) for the system. Each of the EHF tools 10 have a positive terminal 58 and a negative terminal 60. Alternatively, a single negative electrode may be provided within each tool 10 that is selectively connected to ground With continued reference to FIGS. 1-3, FIG. 4 illustrates a production line including three EHF tools. For brevity, components that are similar to the embodiment of FIG. 1 are referred to by the same reference numerals in FIG. 3. Press loading robots 62 are illustrated with each robot 62 feeding a clamping press with an EHF tool at 64. While three robots 62 are shown, it may be possible to use a single robot to load all three of the EHF tools 10 at 64. An EHF pulse generator 66, such as for example the bank of capacitors 54 shown in FIG. 3, is illustrated at 66 that provides a pulse sequentially to each of the EHF tool at 64. The pulse generator provides a pulse within each chamber 20 to cause the liquid 22 to form a plasma discharge shockwave that forms the blank 16 into die cavity 32 of the one-sided die 30. After the part is formed by one or more EHF pulses, a press unloading robot unloads each of the EHF tools at 64. The robot unloads the part to a blank post 70 that comprises a fixture disposed between the EHF tool and the next step on the production line. While three robots 68 are shown, it may be possible to use a single robot to unload all three of the EHF tools 10 at 64. A trim press loading robot at 72 takes the blank 16 and loads the trim press at 74. A trim press unload robot 76 is provided for unloading the trim press 74. The trim press unload robot 76 loads a rack or other device for transporting parts at 78. The parts are then checked according to quality control standards at 80.

Referring to FIG. 5 with continued reference to FIGS. 1-4, a forming and trimming diagram 82 is presented that corresponds to a forming and trimming operation as described with reference to FIG. 4. According to the diagram 82, three EHF presses are referred to as EHF press 1, EHF press 2 and EHF press 3. All three feed parts to a trimming press. In the first phase of the cycle, blank 1 is loaded into the EHF tool, the EHF tool is clamped and the chamber is filled with liquid. At the same time, EHF press 2 is in the process of draining the chamber, unclamping the tool and unloading part 2. At the same time in EHF press 3, the part is formed and, for example, five EHF pulses are used to form part 3. It should be understood that a different number of EHF pulses may be used to form part 3. At the same time, trim part 1 is trimmed. Trim part 1 was formed in a previous cycle of the EHF tool 10 and is loaded into the trim press from the blank post 70.

In the next phase of the cycle, the EHF press 1 forms a part by discharging five EHF pulses in the chamber 20 of the EHF vessel 18. EHF press 2 is loaded with blank 2, the tool is clamped and the chamber is filled with liquid. EHF press 3 is drained, the tool is unclamped and part 3 is unloaded to the blank post 70. The trimming press trims part 2.

In the third phase of the cycle, EHF press 1 is in the process of draining the chamber, clamping the tool and unloading part 1. EHF press 2 is connected to the source of stored charge and five EHF pulses are used to form part 2. During this time period, blank 3 is loaded into EHF press 3, the tool is clamped and the chamber is filled with liquid. The trimming press in this time period trims part 3 that was previously received from EHF press 3.

The timing of the press cycle is divided into 12 second periods and the total elapsed cycle time is shown at the bottom of FIG. 5 to be 12 seconds for the first phase, 24 seconds after the second phase and a total of 36 seconds after the third phase.

Figures 4, 6:
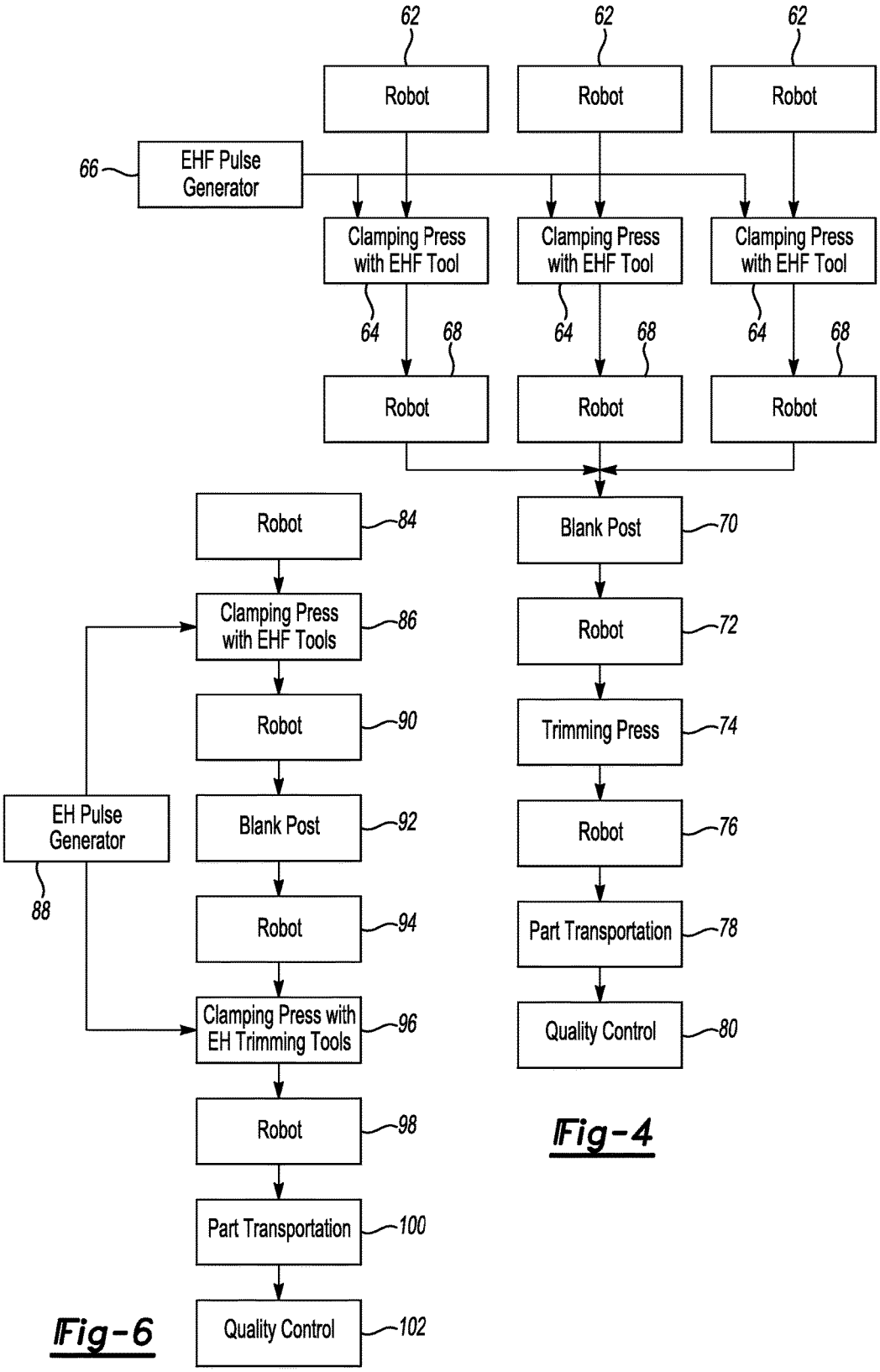
FIG. 4 is a flowchart of a press line including three electro-hydraulic tools on a line that includes a single trimming press.
FIG. 6 is a flowchart of an alternative embodiment of a press line layout with a single EHF tool and a single EH trimming tool.

Referring to FIG. 6, an alternative embodiment is provided that shows a partial operation sequence for a lower rate production line that includes a single EHF tool and a single EH trimming tool. The process described with reference to FIG. 6 begins with a robot at 84 loading a clamping press having an EHF tool at 86. An EHF pulse generator 88 is connected to the EHF tool and the EH trimming tool to provide electro-hydraulic pulses to the EHF tool and the EH trimming tool. A robot 90 unloads the part from the clamping press at 86. The robot moves the part to a blank post at 92 that holds the part until a robot takes the part from the blank post 92 and a trim press load robot loads at 94 it into the clamping press at 96 that is provided with electro-hydraulic trim tools at 96. The part is trimmed in a clamping press with electro-hydraulic trimming tools at 96. A trim press unload robot 98 unloads the part from the clamping press after trimming with the EH trimming tools at 96. The robot 98 loads the parts into a part transportation device, such as a rack, crate or carton at 100. The parts are inspected at quality control at 102. It should be noted that the quality control step may be conducted either on the manufacturing line before loading into the rack at 100 or may be performed at the point at which the racks are unloaded in an assembly facility.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A method of manufacturing an article with a plurality of electro-hydraulic forming (EHF) tools comprising:

clamping a blank separately onto each one of a plurality EHF tools in a progressive sequence; and switching a connection to a single pulse generator;

discharging each of the plurality of EHF tools to sequentially form a plurality of shaped parts; and trimming the plurality of shaped parts sequentially in a single, separate trim press.

2. The method of claim 1 wherein the plurality of EHF tools include three EHF tools and three one-sided dies that are operated by three presses, wherein the progressive sequence further comprises operating the presses in a repeating order.

3. The method of claim 2 wherein a cycle time for the trim press is about one-third of a cycle time for each press.

4. The method of claim 1 wherein a cycle time for the trim press is about equal to a multiplication of a cycle time for each press and the reciprocal of the number of the plurality of presses.

5. The method of claim 1 further comprises:

filling a chamber defined by each of the EHF tools with water;

evacuating air from each of the EHF tools prior to the discharging step; and draining the water from each of the EHF tools.

6. The method of claim 5 wherein the time required for the clamping step, the filling step, the evacuating step, the discharging step and the draining step is a multiple of the time required for trimming the shaped parts in the trim press that corresponds to the number of EHF tools.

7. The method of claim 1 wherein the discharging step further comprises multiple discharges of each of the EHF tools to complete forming the part shape.

* * * * *